US006054959A

United States Patent [19]

Amos et al.

[11] Patent Number: 6,054,959

[45] Date of Patent: Apr. 25, 2000

[54] DUAL RESONANT ANTENNA

[75] Inventors: Sonya Victoria Amos, Old Harlow; Julius George Robson, Great Dunmow, both of United Kingdom

[73] Assignee: Nortel Networks Corporation, Montreal, Canada

[21] Appl. No.: 09/055,059

[22] Filed: Apr. 3, 1998

[51] Int. Cl.[7] ..... H01Q 1/24

[52] U.S. Cl. ..... 343/702; 343/901

[58] Field of Search ..... 343/702, 901, 343/900, 715, 906

[56] References Cited

U.S. PATENT DOCUMENTS

| | | | |
|---|---|---|---|
| 4,868,576 | 9/1989 | Johnson, Jr. | 343/702 |
| 5,412,393 | 5/1995 | Wiggenhorn | 343/702 |
| 5,546,094 | 8/1996 | Egashira | 343/702 |
| 5,699,070 | 12/1997 | Mischenko et al. | 343/702 |
| 5,852,422 | 12/1998 | Imanishi | 343/702 |

FOREIGN PATENT DOCUMENTS

| | | |
|---|---|---|
| 0 359 361 | 3/1990 | European Pat. Off. . |
| 2271218A | 4/1994 | United Kingdom . |

*Primary Examiner*—Don Wong
*Assistant Examiner*—Jim Clinger
*Attorney, Agent, or Firm*—Lee, Mann, Smith, McWilliams, Sweeney & Ohlson

[57] ABSTRACT

This invention relates to an antenna operable in a multi-mode radio transceiver. One aspect of the present invention, provides a radio antenna having resonant frequencies operable to receive and transmit radio signals in different frequency bands according to two operating protocols. In accordance with another aspect of the invention the antenna is operable according to more than two operating protocols and frequency bands. In accordance with another aspect of the invention, there is provided a method of operating the antenna.

15 Claims, 11 Drawing Sheets

DUAL RESONANT ANTENNA

FIELD OF INVENTION

The present invention relates to radio antennas and, in particular, relates to the same for use in a multi-mode mobile radio handset.

BACKGROUND ART

Personal communication networks are being deployed extensively world-wide using cellular mobile radio systems. There are now several cellular communication networks in operation. GSM900 (Global System for Mobile Communications) is the world's most widely used digital network and is in operation in over 100 countries around the world, predominantly in Europe and Asia Pacific. GSM1800 (DCS1800; PCN1800) operates at a higher frequency with respect to GSM900 and is in operation in Europe and Asia Pacific. GSM1900 (PCS1900) is used in the US and Canada and is scheduled for parts of Latin America, Australia and Africa. PDC (Personal Digital Cellular) is a Japanese digital network, AMPS (Advanced Mobile Phone System) is an analogue mobile phone network which is used mainly in the US and also Latin America, and Australia.

Earlier networks, still in operation, use analogue modulation formats for the radio air interface protocol. These analogue networks exhibit the problem of call saturation in high usage areas. To overcome this problem higher capacity air interface protocols using digital modulation format networks have been introduced in tandem, that is an area is covered by both systems. Nevertheless, since analogue networks have been established for a longer period, analogue networks may offer better coverage than digital networks. For example, in the United States and Canada the early standardised analogue network (AMPS) has reached a fairly universal coverage of the populated North American continent. The newer digital networks, however, tend to be deployed in areas of high usage. A result of this is that there are areas of digital network coverage overlaying a universal analogue network coverage.

Additionally, different air interface protocol standards of digital networks have been deployed regionally, since different telecommunications operators have developed their own protocols or have developed such protocols in line with national and sometimes international standards authorities, for example, the GSM protocol. Whilst it is reasonable to suppose that handsets operable for different radio communications protocols are similar from the users point of view, it is not possible, in particular, to use a digital mobile radio in an analogue cellular region and vice versa. This stems from the fact that whilst both types of handsets possess antennas, radio front end transmitter, receiver and baseband circuits, they operate on different air interface protocols which operate, inter alia at different radio carrier frequencies.

Therefore it can be seen that each individual personal communications system user will need to subscribe to two or more network providers for complete coverage. Consequently a mobile phone subscriber may require a handset that will not only function throughout the coverage area of a specific digital network, but also will have the capability to operate over an alternative network such as an analogue network.

The problem of implementing a dual mode handset has been considered to be surmountable by several different approaches; one solution uses two separate radio transceivers piggybacked and combined at the man-machine interface (keyboard and audio); a second solution uses two separate radio sections piggybacked and combined at the digital signal processing part of the radio transceiver,—applicants have a pending application relating to such a scheme, GB9603316.2. These two above approaches have problems in that the radio frequency signals are transmitted and received via an antenna. If the frequencies of operation are different, as indeed they will need to be, then two types of antenna will be necessary.

A number of dual band helical structures have been investigated at the Helsinki University of Technology, and these were presented at the 1996 IEEE VTC Conference. The helical structures presented are shown in FIG. 1. They consist of: (a) two helical antennas, one within the other; (b) a helical-monopole combination; and (c) a helical antenna combined with a wound monopole. The paper states that the dual frequency operation can be obtained from all three of the structures that are shown. Results for structure (a) state that it was tuned to the frequencies 1740 MHz and 900 MHz, and that 10 dB return loss bandwidths were obtained of 5.2% and 2.2% respectively. The dimensions for the antennas were $D_1$=6 mm, $D_2$=3 mm, D=5 mm, $I_{h1}$=12 mm, $I_{h2}$=14 mm, $I_m$=39 mm, $I_h$=13 mm, $N_1$=5, $N_2$=5, $N_3$=7, and $I_s$=10 mm. Results for structure (b) state that it was tuned to the frequencies 1750 MHz and 894 MHz, and that 10 dB return loss bandwidths were obtained of 12% and 4.5% respectively. Structure (c) is simply a more compact version of (b), and not surprisingly has a narrower bandwidth. For the upper and lower bands, measured bandwidths of 11% and 2.9% were obtained where the overall structure height was 34 mm. Thus, in summary these antennas provide a bandwidth which is not sufficient for many radio applications, and also does not leave any margin for manufacturing tolerances.

A dual band external antenna is described by Ali et al in 'A wide band dual meander sleeve antenna', IEEE Antennas and Propagation Society International Symposium, 1995, vol.2 p.1124–7, 18–23 June 1995, Newport Beach, Calif., USA, and this is called the wide band dual meander sleeve antenna. This antenna is described as potentially useful as a low profile antenna for a dual mode handset. However, the results presented in the paper are for the case where the experimental antenna is mounted on a large ground plane (90 $cm^2$) and as such would not be suitable for applications such as mobile telecommunications handsets. A single mode antenna small enough to be retracted within the casing of a handset has been proposed in various forms: the same cannot be said to be true for dual/multi-band antennas.

Applicants propose several types of dual/multi resonant antennas which provide sufficient bandwidth in the appropriate bands, as described in co-pending U.S. application Ser. Nos. 08/936314 and 08/943384. It is believed that these antennas may not be as compact as demanded by the trend for an overall decrease in mobile handset size.

OBJECT OF THE INVENTION

The present invention seeks to provide a multi-mode mobile handset antenna which has a number of resonance bands and overcomes the aforementioned problems.

The present invention further seeks to provide an antenna for a cellular radio transceiver which is aesthetically pleasing, low cost in terms of manufacture, of high strength and electrically efficient.

STATEMENT OF THE INVENTION

In accordance with one aspect of the present invention, there is provided a mobile radio handset antenna operable at first and second resonant frequencies, the antenna comprising a whip antenna element and a feed, wherein the antenna element is movable between first and second indexed positions with respect to the feed, which feed couples at radio frequency with the antenna element, whereby, in the first indexed position, the element defines a resonant length corresponding to a quarter of a wavelength at a first frequency of operation and, in the second indexed position, the element defines a resonant length corresponding to a quarter of a wavelength at a second frequency of operation.

In accordance with a second aspect of the invention, there is provided a radio antenna operable at two distinct resonance bands, the antenna comprising a whip element which is slideably retained relative to a feed, said whip element having a base end associated with the feed and a distal end at an opposite end to the base end;

wherein the antenna is adapted to be energised relative to the feed, the whip being locatable with the feed element at a number of predetermined points whereby the electrical length of the whip from the feed point to the distal end corresponds to an odd number of quarter wavelengths at a desired frequency.

In accordance with another aspect of the present invention there is provided a mobile radio handset operable in accordance with two operating protocols comprising an antenna, dual mode intermediate frequency circuitry, dual mode baseband circuitry and audio-electrical interaction equipment, herein the antenna radiating element comprises a whip antenna element which is slideably retained relative to a feed.

The feed arrangement can be reactive whereby no metal to metal contact is involved between the feed and the whip. The feed arrangement can be by direct contact of conductive members. The antenna may also be matched with a matching network whereby the whip antenna can operate as a call set-up antenna, irrespective of the position of the extension of the whip antenna relative to the base. The antenna may be supplemented by one or more call set-up antennas, which antennas are operable irrespective of the position of the extension of the whip antenna relative to the base. The antenna may comprise a single section whip element which is slideable relative to a base member. The antenna may comprise at least a first member telescopically engaged relative to a second whip element.

The distal portion of the central element can also be encased within a dielectric material. The ability of the central conductor to be retractable within a handset makes the unit more compact or more easily stored. This can improve the robustness of the design and safety.

In accordance with a still further aspect of the present invention, there is provided a method of operating a dual resonant frequency radio antenna operable at two wavelengths $\lambda_1$ and $\lambda_2$, where $\lambda_1$ is the higher frequency, the antenna comprising a whip antenna element and a feed, the antenna having a distal end at one end at the whip; wherein the antenna is movable between first and second positions with respect to the feed; wherein responsive to the receipt of an incoming call or otherwise in a first position, the resonant length corresponds to a quarter of a wavelength at a first frequency of operation and, in a second position, the resonant length corresponds to a quarter of a wavelength at a second frequency of operation whereby communications occur at a particular frequency of operation.

BRIEF DESCRIPTION OF DRAWINGS

In order that the present invention can be more fully understood and to show how the same may be carried into effect, reference shall now be made, by way of example only, to the Figures as shown in the accompanying drawing sheets wherein:

FIGS. 6*a*, 6*b* and 6*c* show a second dual resonant antenna made in accordance with the invention in three positions;

DETAILED DESCRIPTION OF THE PREFERRED EMBODIMENTS

There will now be described by way of example the best mode contemplated by the inventors for carrying out the invention. In the following description, numerous specific details are set out in order to provide a complete understanding of the present invention. It will be apparent, however, to those skilled in the art that the present invention may be put into practice with variations of the specific. It is to be noted that the reference to frequency band and frequency are used interchangeably within the specification for reasons of convenience, since the upper and lower resonant frequencies do not exist at spot frequencies, but rather across a range or band of frequencies.

Figure 1A:
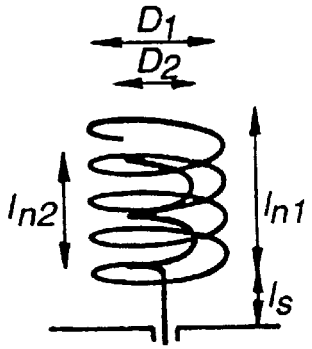
FIGS. 1*a*, 1*b* and 1*c* depict three dual frequency antenna configurations.
Figure 1B:
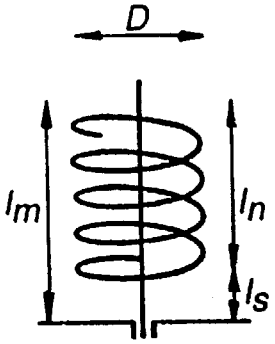
Figure 1C:
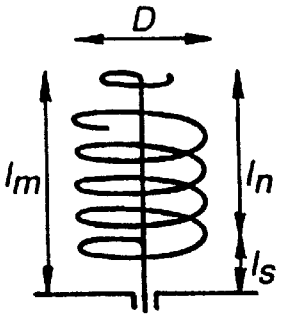
Figure 2:
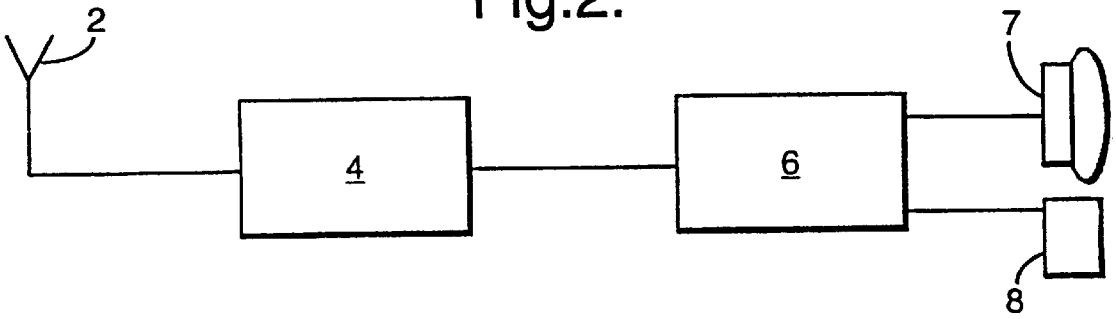
FIG. 2 depicts a typical handset schematic.

In order that a full understanding of the invention be attained, a brief reference shall be made to a typical cellular radio handset which FIG. 2 shows a block diagram thereof. Radio frequency signals are received and transmitted by the antenna 2 which is connected to a radio front end 4. In the radio front end, transmit and receive signals are converted between radio frequency and base band, whereby digital signal processing means 6 encode the transmit and decode the receive signals and from these can determine the audio signals which are communicated to and from the handset user by loudspeaker 7 and microphone 8. The front end will typically contain transmit and receive paths which are mixed to an intermediate frequency with a local oscillator. These intermediate frequency signals will be further processed and mixed so that the input and output signals to and from the front end are at baseband and suitable for digital to analogue or analogue to digital conversion, as appropriate, prior to digital signal processing.

Figure 3:
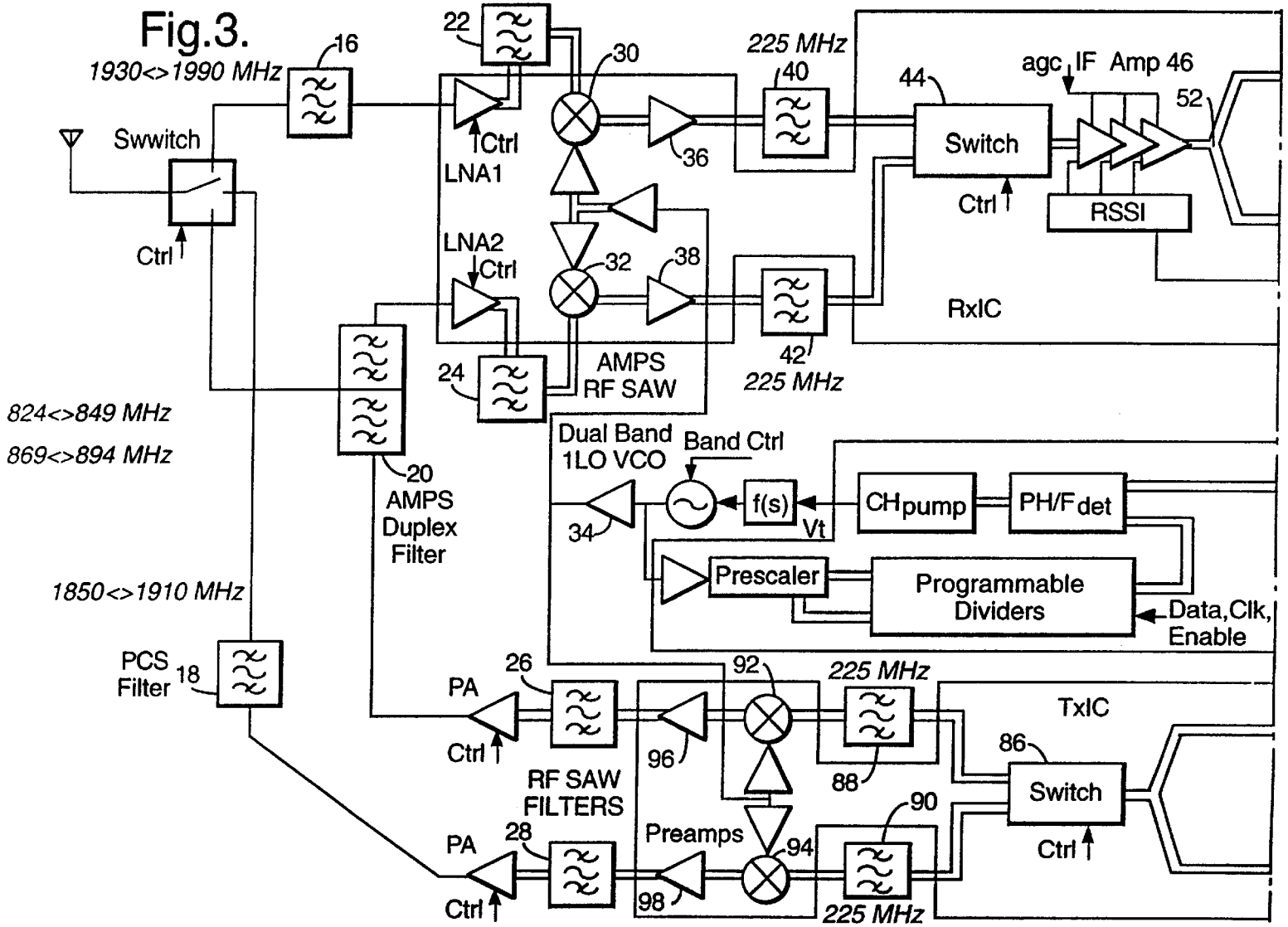
FIG. 3 is a detailed implementation of a dual mode radio front end.
Figure 3:
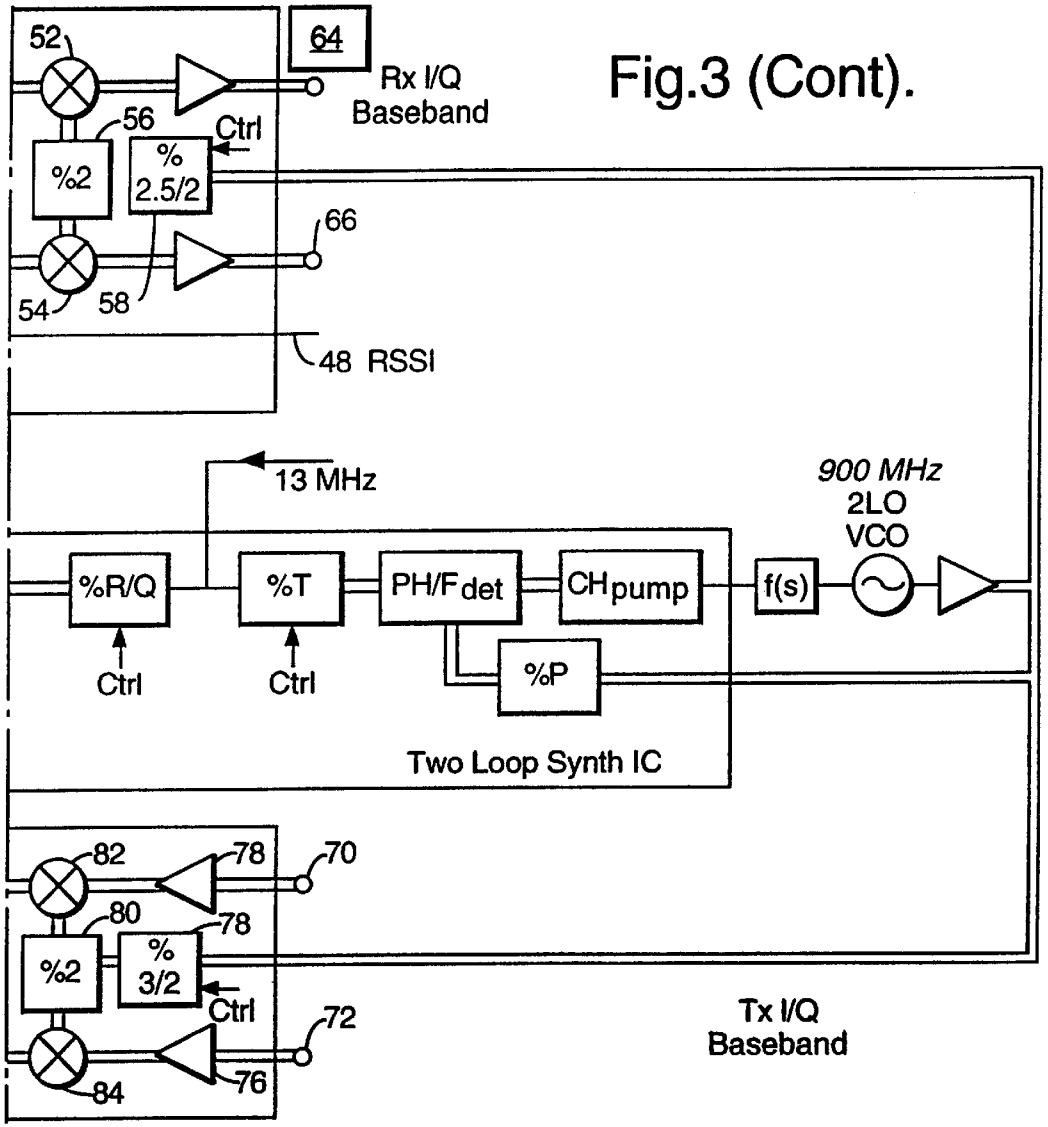

Referring now to FIG. 3, there is shown a handset architecture, comprising a dual mode radio front end for the reception of both digital PCS 1900 signals and analogue AMPS signals. PCS 1900 operates in the frequency band 1930 to 1990 MHz on the receive downlink to the handset and in the 1850 to 1910 MHz band on the transmit uplink from the handset. AMPS operates in the frequency band 824 to 849 on the transmit uplink from the handset and in the 869 to 894 MHz band on the receive downlink to the handset.

PCS 1900 operates either in an uplink mode or in a downlink mode; AMPS can operate in both modes simultaneously. For this reason the switch 14 from the antenna 12 has three positions. Details of the antenna are not shown in this figure for simplicity.

Turning now to the receive path for the digital PCS 1900 signals, when the switch 14 directs incoming digital PCS 1900 signals to the PCS 1900 receive path, the signals from the band select filter 22 are passed to a mixer 30 which mixes the received signal with a signal from a synthesised local oscillator 34 to produce an intermediate frequency (IF) signal at 225 MHz which is subsequently amplified by further amplifying means 36. The PCS 1900 signals are passed through a second switching circuit 44 which operates simultaneously with the first switch 14 by mode control means (not shown).

The mode control means identifies whether the signals are digital or analogue modulation and determines in which mode the transceiver is operating and takes into account the actual position of the antenna. The receive signal output from which 44 is fed to an IF amplifier with automatic gain control and a receive signal strength indicator (RSSI). If an analogue AMPS radio signal were present at the antenna and a decision made to receive that signal, the switch 14 would feed the signal from the antenna 12. For transmit, the PCS 1900 and AMPS baseband signals are raised to 150 MHz and 225 MHz intermediate frequencies (IFs) respectively. The upconverted IF containing either the PCS 1900 signal at 150 MHz or the AMPS signal at 225 MHz is applied respectively to the PCS 1900 transmit band at 1850 to 1910 MHz and the AMPS transmit band at 824 to 849 MHz. The respective signals are RF band filtered by 26 and 28 prior to power amplification and then fed to the antenna via separate filters and switch 14.

The main factors that should be taken into account in the design of an antenna are electrical performance, volume required (internally), cost, and manufacturability. With regard to the electrical performance of antennas, the main performance parameters are: radiation efficiency; isolation (where two elements are used); typically the return loss should be >10 dB across the operating band. Thus the PCS antenna requires a 7.3% 10 dB return loss bandwidth, while the AMPS antenna requires a 8.1% bandwidth. Mean effective gain is a measure of the handset antenna radiation pattern, and involves the multi-path angular density function. Permitted SAR levels are fixed by regulatory limits. Radiation efficiency, should be greater than −2 dB for the handset in isolation (ideally >−1 dB for external antennas), whilst the handset in the presence of the head and hand should have an efficiency of greater than −3 dB.

Figure 4:
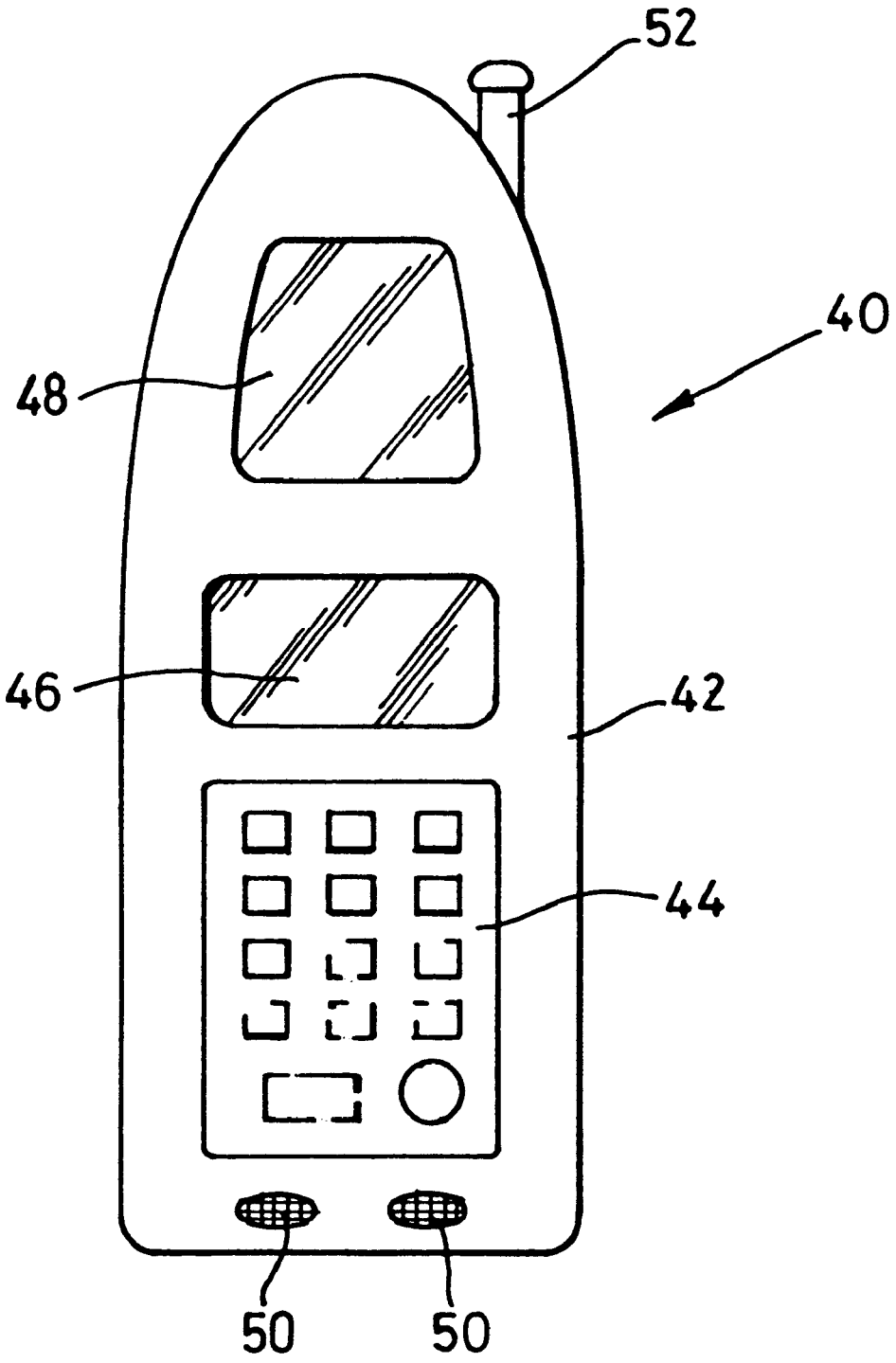
FIG. 4 shows a front view of a handset.

Referring now to FIG. 4, there is shown a first embodiment of the present invention. A mobile radio handset 40 has a body 42 having a keypad 44 display 46 and microphones 48, 50. The antenna 52, in its simplest form, comprises an extendable telescopic whip antenna. In operation the antenna 52 co-operates with a conductive electronics shielding arrangement or shielding can (not shown) which encloses the electronic circuitry to, inter alia, reduce or prevent radiation emanating from the electrical circuitry whereby the generation of intermodulation products is minimised; the antenna and shielding can form a dipole. The resonant frequency of operation is predominantly controlled by the whip antenna length according to the following equation:

$$F_{res} = \frac{C}{4L}$$

where:

C is the speed of light

L is the length of the antenna element.

Signals at other frequencies will resonate as determined by the following equation:

$$F_{harm} = \frac{(2n-1)c}{4L} \text{ where } n = 1, 2, 3 \ldots$$

Typically, for a mobile radio handset, the antenna is a quarter wavelength (λ/4) in length in order to be resonant at the required frequency.

Figure 5A:
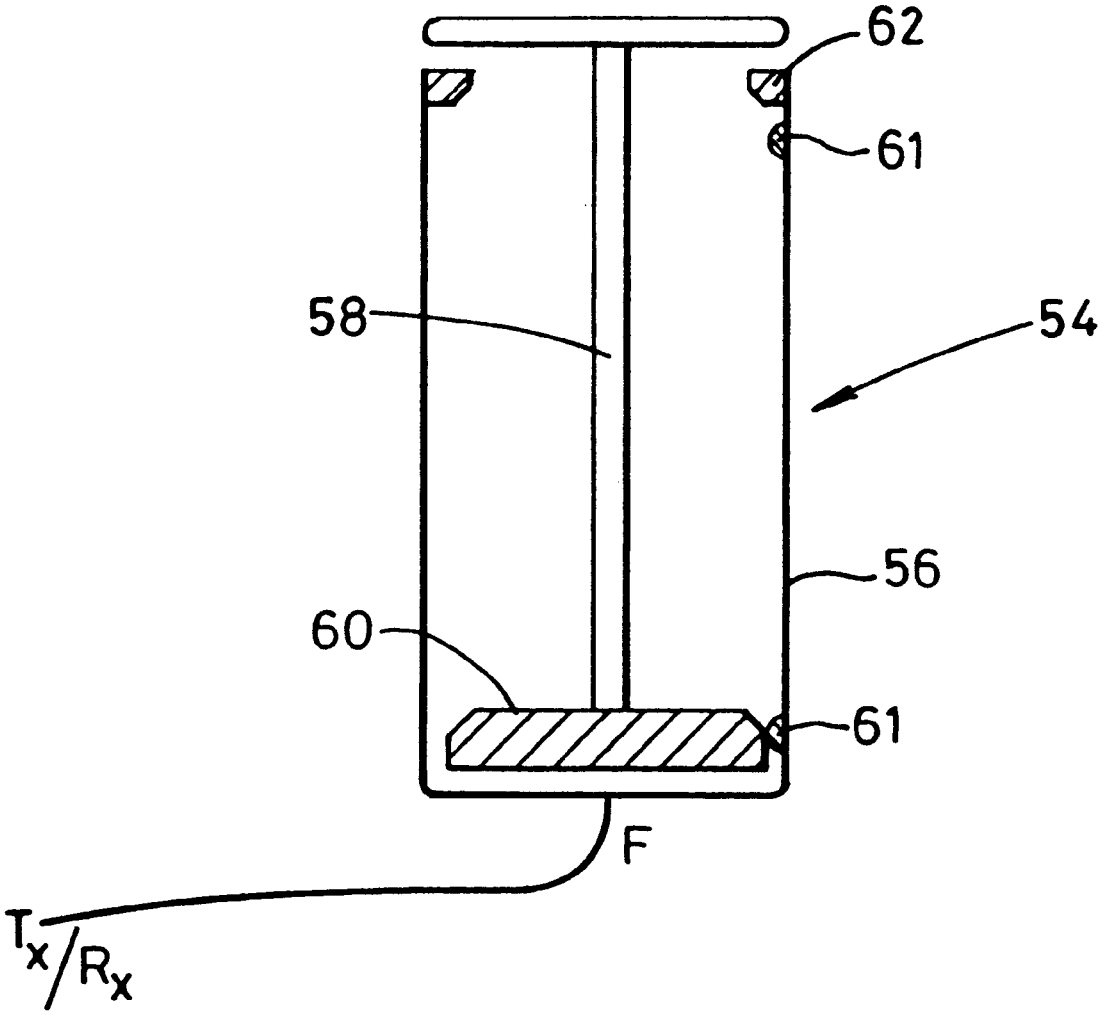
FIGS. 5*a* and 5*b* show a first dual resonant antenna made in accordance with the invention two positions.

This first embodiment as shown in FIGS. 5*a* and 5*c* operate as a dual mode telescopic antenna; in a first retracted position the antenna is tuned to a first frequency and in a second, extended position the antenna tuned to a second frequency which second frequency is lower than the first frequency. The antenna 54 receives signals from/passes signals to an antenna feed F which is connected to transmit and receive circuitry $T_x$/R. The antenna comprises a first conductive tubular element 56 which retains an extendable second whip element 58. Whip element 58 is provided with a piston 60 which positions a proximal end of the whip element within the tubular element and aligns the whip element with respect to an opening in the tubular element defined by contact 62. In a low frequency mode of operation the whip element 58 is extended such that a contact arrangement associated with the piston 60 makes electrical contact with the contact 62, whereby the electrical length corresponds to a quarter of the wave length at the lower frequency. To ensure that reliable contact is maintained a detent biasing means 61 can operate as an indexing means. Indexing means could be provided by means of a visual indicator on the handset display.

Call set-up procedure is such that when the whip antenna element is non-extended or partially extended then only the tubular antenna element is connected to the feed. The tubular element may act as a call set-up antenna if a matching network is provided for the reception of low frequency call set-up signals. When the whip element is fully extended then the element must also act as a call set-up antenna for the higher frequency signals.

A problem that arises in the use of a single antenna tuned to a particular frequency band is that the antenna in a position operable to receive signals at that particular frequency will not necessarily be able to receive call set-up signals at the other frequency from a base station providing cellular coverage for the actual location of the mobile subscriber.

Referring again to FIG. 3, there is shown a mode control switch 14. In order to initiate a receive call, the handset needs to receive a call set-up signal from a base station. The mode control switch takes into account that the handset does not have its main antenna tuned into a particular receive band. Typically a secondary antenna—a call set-up antenna—is employed, which is less efficient than the primary antenna. Call set-up signals carry less information than the normal communication signals and are thus less prone to error: the call set-up antennas do not need to be as sensitive as the main antenna. This secondary antenna is capable of receiving signals in the case that the main antenna is not tuned in to such signals—for instance when the main antenna is in a retracted/extended or in an intermediate position. In the case of a dual mode radio handset, either the call-set-up antenna must be sufficiently resonant at both frequencies whereby a call may be set-up (and an indication/instruction is given to the user that the antenna is in the correct position/needs repositioning in so as to be resonant with the desired frequency of operation).

Figure 6A:
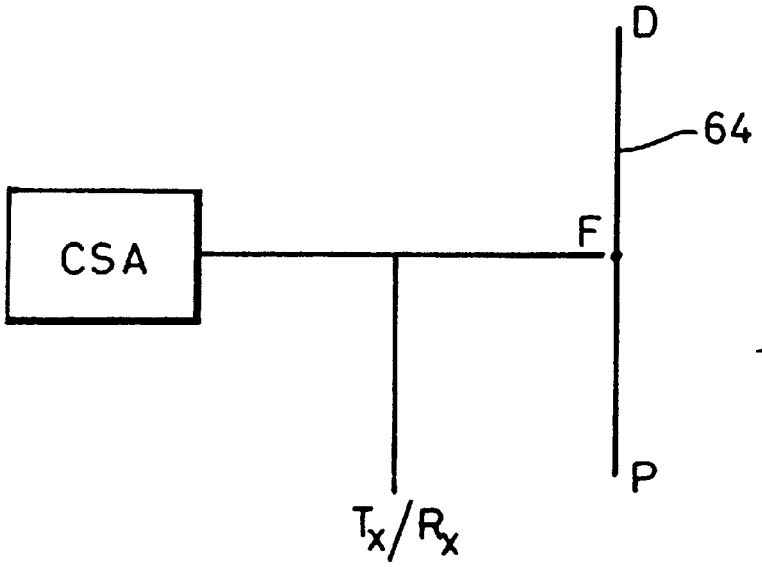
Figure 6B:
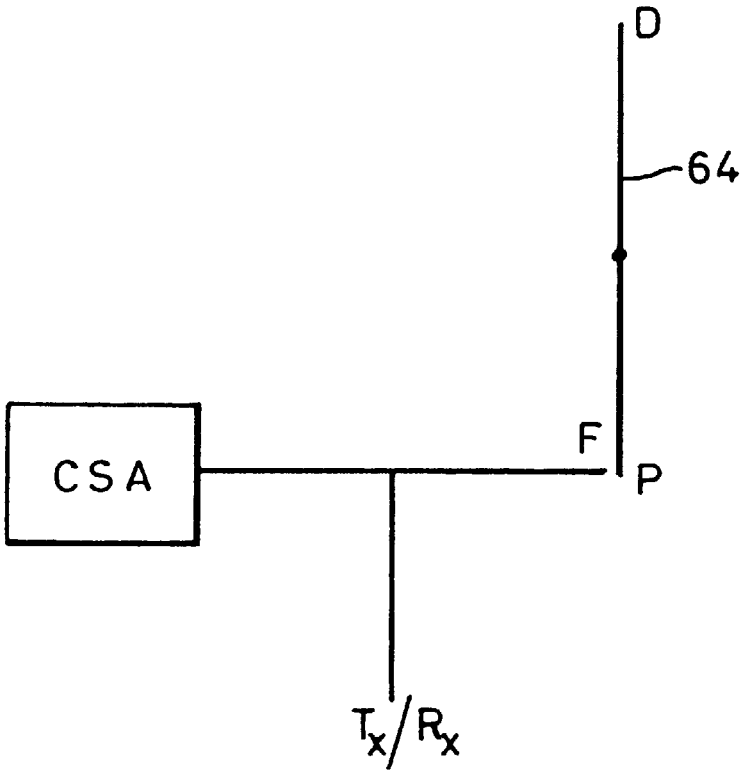

FIGS. 6*a* and 6*b* show a first variant of the two position whip wherein the antenna 64 as a whole slides relative to a feed point F. A disadvantage of such a system are that the whip element on the opposite end to the distal end D, the proximal end P, will tend to radiate when the antenna is retracted. Details of overcoming such problems will be discussed later with reference to FIGS. 10*a* and 10*b*. The element CSA corresponds to a call set-up antenna which is independent of the primary antenna. Again detent biasing means, not shown, can be employed to provide indexing means.

Figure 7A:
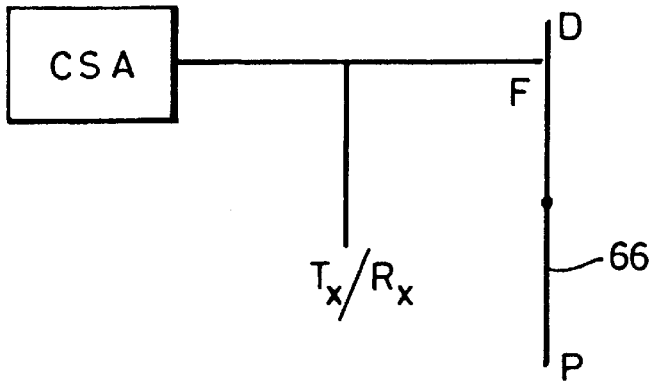
FIGS. 7*a*, 7*b* and 7*c* show a third embodiment of an antenna made in accordance with the invention in three positions.
Figure 7B:
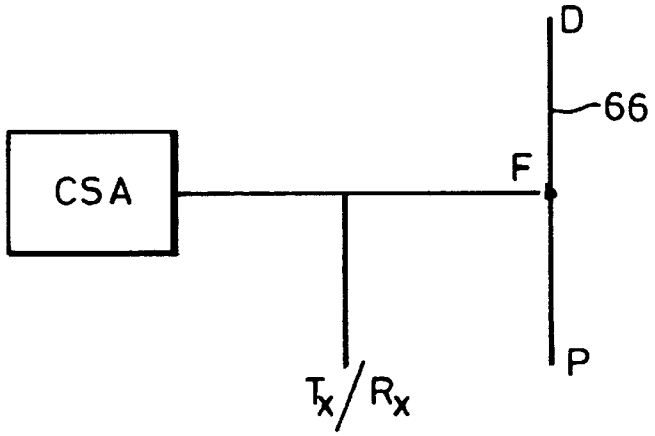
Figure 7C:
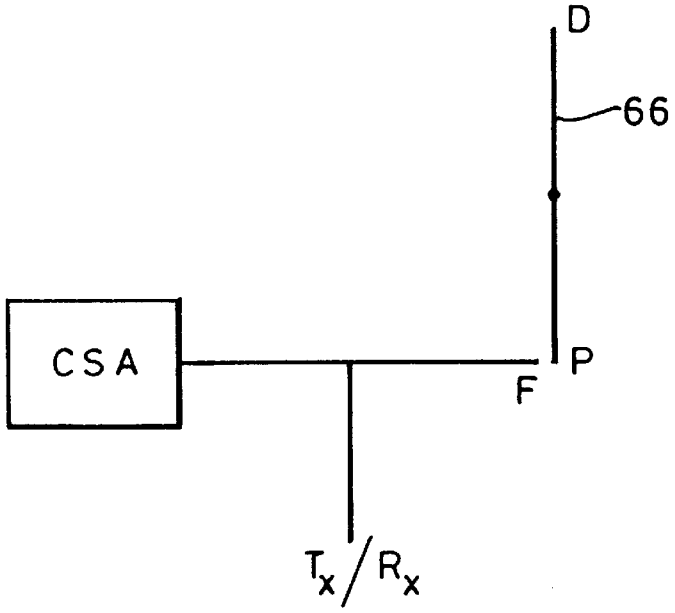

FIGS. 7*a*, 7*b*, 7*c* show a third embodiment of the invention wherein the antenna comprises a single element whip 66 which is moveable between three positions; (7*a*) a fully retracted position, (7*b*) a fully extended position to receive signals at a second frequency and a low frequency, and (7*c*) a position intermediate the fully extended and fully retracted position wherein the antenna is tuned into a frequency higher than that supported by the antenna in the fully extended state. Further embodiments are possible wherein there are several intermediate positions and the handset is capable of operating in more than two operating protocols.

Figure 8A:
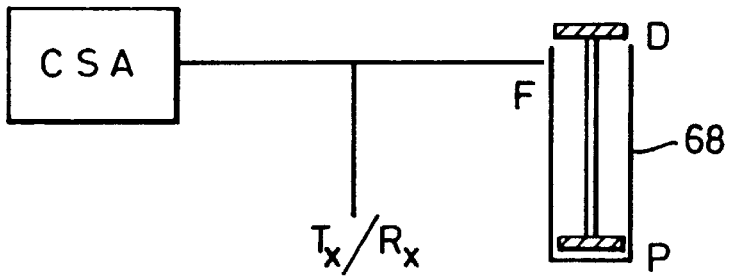
FIGS. 8*a*, 8*b* and 8*c* show a fourth embodiment.
Figure 8B:
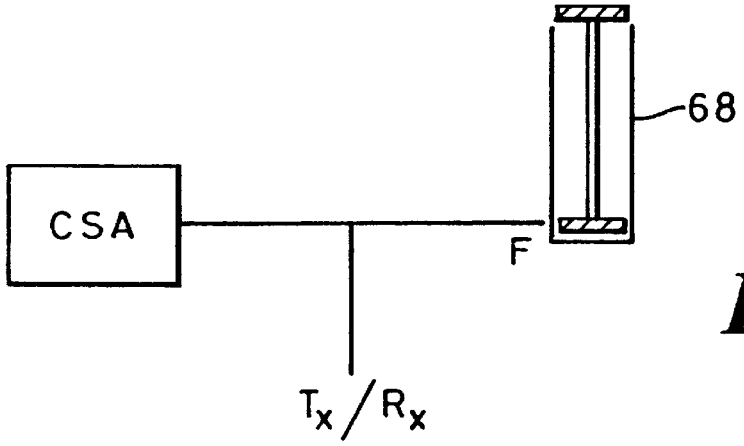
Figure 8C:
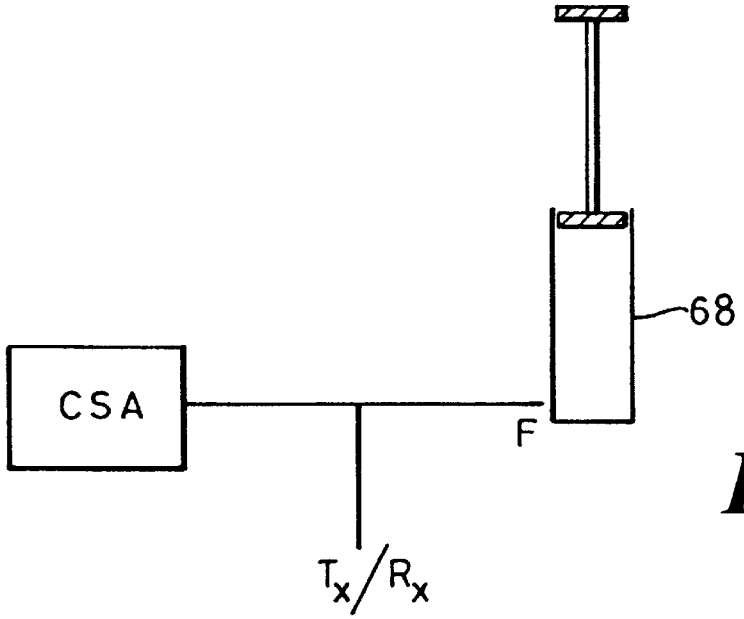

In both the embodiments shown, when the antenna is in use in a partially extended state, the non-extended part of the antenna will also tend to radiate and will parasitically couple reducing the efficiency of the antenna and increase unwanted radiation which would interact with the user's body. FIGS. 8*a*, 8*b* and 8*c* show back and side views of a full length antenna and its interface to a handset (note that the antenna shown is in a fully retracted state, the whip antenna being reactively coupled with the helix feed arrangement, the helix antenna activity as a call set-up antenna.

Figure 5B:
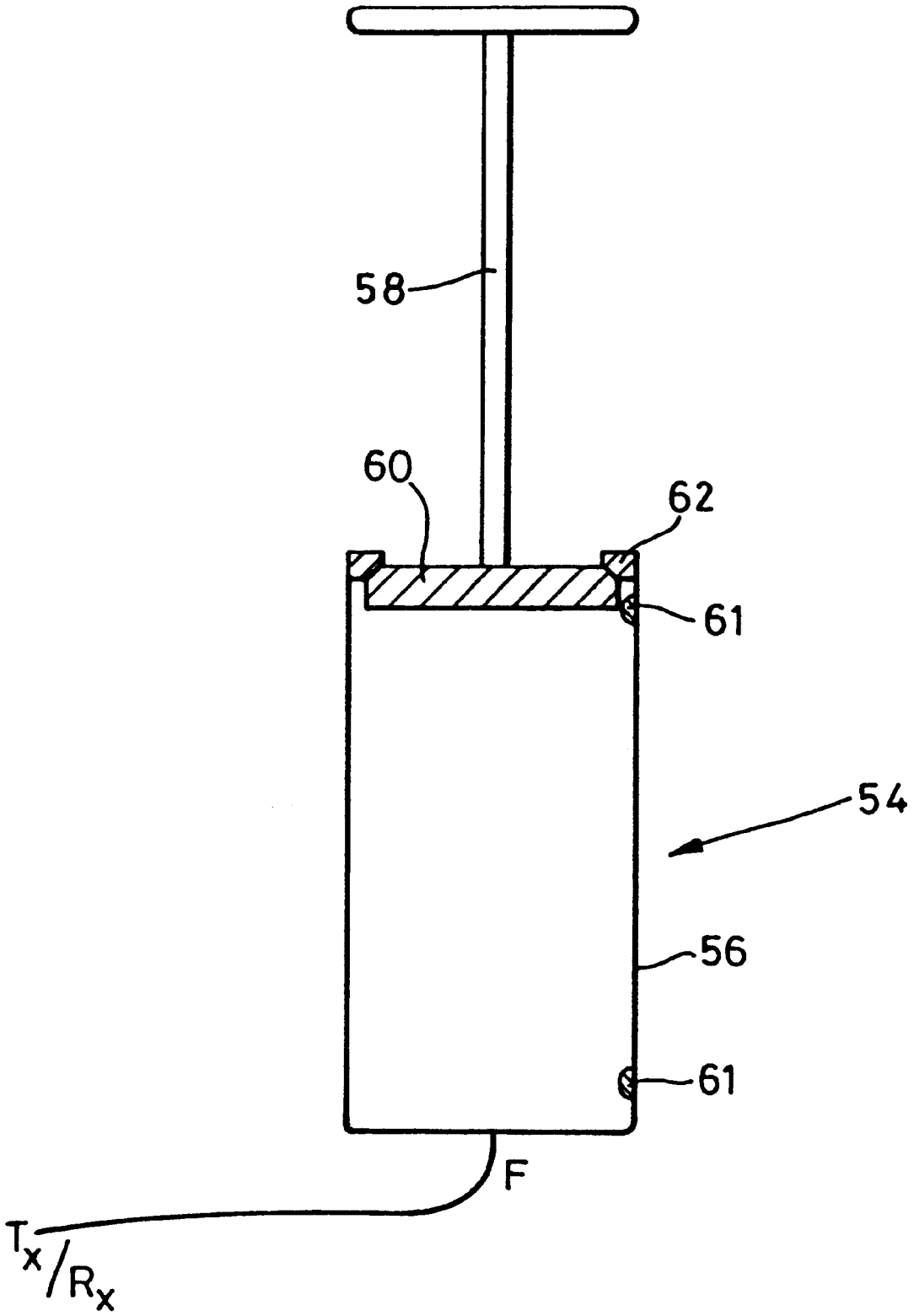
Figure 9A:
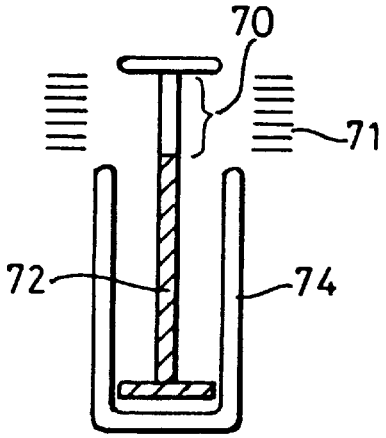
FIGS. 9*a*, 9*b* and 9*c* show a reactive coupling arrangement for feeding the antenna as shown in FIGS. 8*a*–8*c;*
Figure 9B:
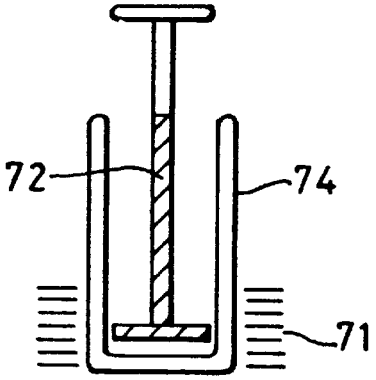
Figure 9C:
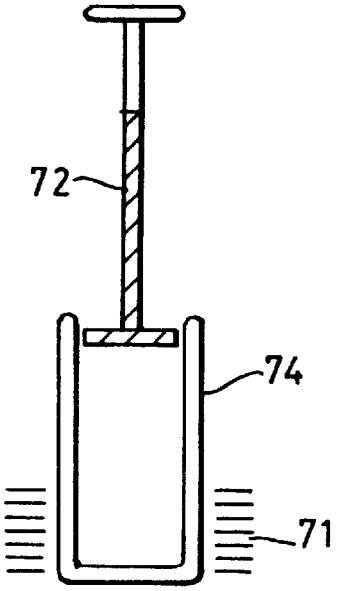

FIGS. 9*a*, 9*b*, and 9*c* show a still further antenna wherein an antenna 68 is slideable with respect to a feed. FIG. 9*a* shows the antenna in a retracted state and the antenna is telescopically movable between two operating positions FIGS. 8*b*, 8*c*. The details of the whip within the tubular element are similar to that as discussed with reference to FIGS. 5*a* and 5*b*. A call set-up antenna (CSA) is required for this arrangement, but no shorts or the like are regarded at the proximal end P to prevent unwanted radiative emission from the antenna on the opposite of the feed F to the distal end D, since the feed and the proximal end is preferentially arranged such that coupling only occurs when the antenna is in the first or second operating positions.

FIG. 9 details a coupling method of feeding the antenna element. In FIG. 9*a* the helix call set-up antenna 71 does not interact with a non-conductive portion of antenna 70. FIG. 9*b* shows the first extended position wherein an inner whip element 72 lies within a tubular antenna element 74. The inner whip element 72 reactively couples with the helix element. FIG. 9*c* shows the whip element 72 fully extended and the antenna is resonant with the low frequency.

Matching circuitry can enable the primary antenna to act as a call set-up antenna when not in a fully retracted position. Variations in an inductive feed can occur; for instance, the feed could be capacitive at high frequency and by direct feed to antenna element at low frequency. The contact is easily realisable as a spring contact operable by detect means, pull and thrust or other means.

As mentioned above, it is necessary for some designs to decouple the antenna portion on the opposite end of the feed to the distal end D. Two types of decoupling arrangements are shown in FIGS. 10*a* and 10*b*.

Figure 10A:
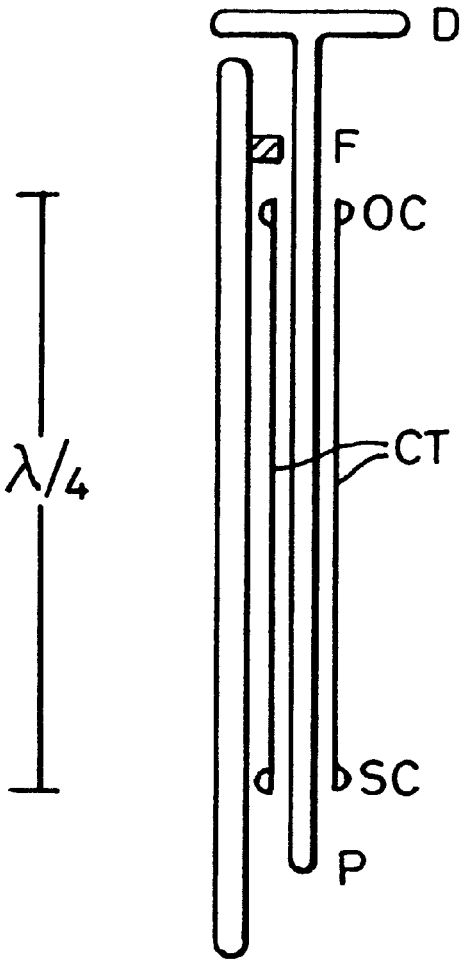
FIGS. 10*a* and 10*b* show two decoupling arrangements.

A ¼ choke could be realised using a conducting tube CT as shown in FIG. 10*a*. This transforms a short circuit SC provided by the unextended portion of the whip P to an open circuit OC at the base of the helix. Reducing the potential of the tube at both ends to ground would help reduce the current flowing on the outside of the choke, reducing interaction with the user hand.

Figure 10B:
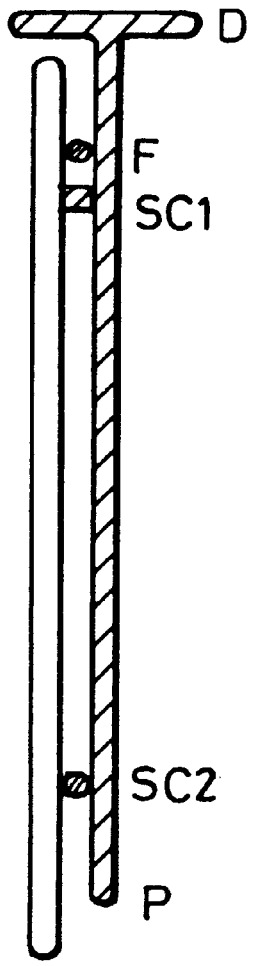

The transmission line decoupling arrangement as shown in FIG. 10*b* would also create an open circuit at the base of the helix by using short SC1 only. However it is likely that this would be susceptible to loading from the users hand. An alternative approach would be to use short SC2 to connect the whip to ground near the base of the whip P.

All of the decoupling methods may change the impedance of the helix, requiring further work to achieve a match for both antenna states. Furthermore, all decoupling arrangements require consequential mechanical changes to the antenna and the shielding can.

For the two position antenna, it would be possible for the antenna, when in a position to receive signals (including call set-up signals) from one network positions to have a capability to receive signals from the other network—if provided with a suitable matching network and loading to enable this. At the higher frequency, the distance from the feed point to the distal point of the antenna in a retracted position simply appears as a quarter wave monopole. At the lower frequency, when the antenna is in an extended position, the antenna operates in a fundamental mode of operation over the whole of the antenna length. If the overall length is approximately $3\lambda_{HF}/4$ and then a first harmonic can be generated at the higher frequency; if the antenna is left, when not in use, with the antenna fully extended, then no dedicated call set-up antenna would be required. Nevertheless, this would not necessarily be practicable. A further problem would, however be realised for the situation where the antenna was neither fully retracted nor fully extended. Accordingly, it is preferable that each mode of frequency band/modulation format was supported by a call set-up antenna. The call set-up arrangement could be arranged such that incoming signals requesting call set-up were ignored if the handset was already in operation, although this would limit any call-back features which can be supported by some systems for single mode handsets. Nevertheless, the base station could inform the mobile after such a call that an attempt had been made to communicate.

Typically, as occurs with most mobile handsets which have a telescopic antenna the call set-up circuit automatically comes into operation when the telescopic antenna is retracted from an operating position by virtue of a contact switch arrangement or otherwise.

In the simplest embodiment of the invention and as shown in FIG. 5, there is only one antenna: this acts as a main antenna in each of the extended and retracted positions of operation and acts as a call set-up antenna with appropriate matching circuits for operation at the other frequency of operation or for both frequencies when in an intermediate position. Difficulties arise in that the antenna would not necessarily be sufficiently resonant, to receive call set-up signals in all intermediate positions.

Preferably, there is at least one auxiliary call set-up antenna whereby the probability that a call set-up signal not being received is low. Such a call set-up antenna could take the form of a helix placed at the bottom of a main telescopic antenna. Matching circuitry to cover an antenna operable to cover two frequency bands may be complicated.

One aspect of the design which does not improve performance at the lower operating frequency is the stub which provides an inductive reactance at the open end at the lower frequency. This can affect the input impedance such that some matching is required.

The design of the present invention does not rely upon there being a frequency ratio of two as is necessary for some dual resonance designs. If the frequency ratio of he high frequency HF to the low frequency LF was 3:1, then if the antenna was tuned to receive quarter wavelength signals at the lower frequency, then the antenna would be of length $\lambda_{LF}/4$ between the electrical distance from the distal end of the antenna to the feed point and, accordingly would be of length $3\times\lambda_{HF}/4$. That is to say the antenna would be resonant at the high frequency, and the low frequency at the same time.

The distal portion of the central element is typically enclosed by a suitably elastic and flexible dielectric whereby the physically sharp end may be encased to provide convenience for users of mobile communication handsets, whilst simultaneously providing an improved aesthetic qualities of the design. Furthermore, the electrical length at the lower frequency is reduced, whereby the overall length of the antenna is reduced. For convenience the central element could be made such that it is flexible to a certain extent. Antennas comprising tightly twisted/coiled wire, as are known, are particularly suitable.

If it was desired to reduce the length of the antenna, it would be possible to coil the distal section of the central section whereby the distal section is reduced in physical length. This would result in a reduction in the bandwidth available, but this is possible for certain scenarios. It is possible to place a material with a similarly high dielectric constant around the central element from the feed to the base of the tube, to reduce the physical length yet retain the electrical length. Nevertheless, a reduction in bandwidth at the higher frequency may result from placement of such additional dielectric material.

In operation, the sequence of events is similar to that of a normal single mode handset, save for the fact that, if the user wishes to make a call, then he must decide upon which network to use. A users decision could be made dependent upon signal strength indicators as provided by the call set-up antenna(s) or by separately testing the signal field using the main antenna in both positions. Equally, call charges may be reduced by one operator and accordingly such criteria may be employed. Call saturation for a first operator's channels may determine that a second operator's channels. The determination of the particular operator may be made by the relative position of the antenna or by a separate switch. Once transmit call set-up has been achieved, then operation of a handset made in accordance with the present invention is similar to that of a normal phone. If a separate call set-up antenna is employed then, if the main antenna is detuned (i.e. is pulled out or retracted during a call) then provision may be made to revert to the call set-up antenna in the instance that the main antenna is detuned to an efficiency less than that provided by the call set-up antenna.

In receive mode the situation is perhaps more logical; the frequency band chosen by the person making the call determines at which position the main antenna should be made to or, as the case may be remain.

We claim:

1. A mobile radio handset antenna operable at first and second resonant frequency bands, the antenna comprising a whip antenna element and a feed, wherein the antenna element is movable between first and second indexed positions with respect to the feed, which feed couples at radio frequencies with the antenna element, whereby, in the first indexed position, the element defines a resonant length corresponding to a quarter of a wavelength at a first frequency band of operation and, in the second indexed position, the element defines a resonant length corresponding to a quarter of a wavelength at a second frequency band of operation.

2. A mobile radio antenna, according to claim 1, wherein the whip antenna element comprising telescopic parts including a tubular section within which a whip element is slideable.

3. A mobile radio antenna, according to claim 2, wherein the whip element is in electrical contact with the tubular element only when fully extended.

4. A mobile radio antenna according to claim 3 wherein the whip element is in electrical contact with the tubular element by means of a detent contact arrangement.

5. A mobile radio antenna according to claim 2 wherein the tubular element is moveable with respect to the feed whereby the antenna can be retracted from the high frequency operating position.

6. A mobile radio antenna according to claim 1 wherein the whip antenna comprises a single length of conductive material.

7. A mobile radio antenna according to claim 6 wherein the extension of the antenna length is determined by a detent.

8. A mobile radio antenna according to claim 5 wherein in a partially or fully retracted position the antenna section at the opposite end to the distal end is decoupled with respect to the feed.

9. A mobile radio antenna according to claim 7 wherein in a partially or fully retracted position the antenna section at the opposite end to the distal is decoupled with respect to the feed.

10. A mobile radio antenna according to claim 1 wherein there is provided a separate call set-up antenna.

11. A mobile radio antenna according to claim 1 wherein radio signals are transferred to the antenna radiating element via direct conductive contact.

12. A mobile radio antenna according to claim 11 wherein radio signals are transferred to the antenna radiating element via reactive coupling.

13. A radio antenna operable at two distinct frequency bands, the antenna comprising a whip element which is slideably retained relative to a feed, said whip element having a base end associated with the feed and a distal end at an opposite end to the base end;

wherein the antenna is adapted to be energised relative to the feed, the whip being locatable with the feed element at a number of predetermined points whereby the electrical length of the whip from the feed point to the distal end corresponds to an odd number of quarter wavelengths at a desired frequency band.

14. A mobile radio handset operable in accordance with two operating protocols comprising an antenna, dual mode intermediate frequency circuitry, dual mode baseband circuitry and audio-electrical interaction equipment, wherein the antenna radiating element comprises an antenna in accordance with claim 1.

15. A method of operating a dual resonant frequency radio antenna operable at two wavelength bands $\lambda_1$ and $\lambda_2$, where $\lambda_1$ is the higher frequency band, the antenna comprising a whip antenna element and a feed, the antenna having a distal end at one end at the whip; wherein the antenna is moveable between first and second positions with respect to the feed; wherein responsive to the receipt of an incoming call or otherwise in a first position, the resonant length corresponds to a quarter of a wavelength at the first frequency band of operation and, in a second position, the resonant length corresponds to a quarter of a wavelength band at a second frequency of operation whereby communications occur at a particular frequency band of operation.

* * * * *